United States Patent [19]

Teltscher

[11] 4,212,226

[45] Jul. 15, 1980

[54] DEVICE AND METHOD OF ILLUMINATING A TARGET BY THE EYE-MOTION OF AN OPERATOR

[76] Inventor: Erwin S. Teltscher, 69, Diana's Trail, Roslyn, N.Y. 11576

[21] Appl. No.: 917,733

[22] Filed: Jun. 21, 1978

[51] Int. Cl.[2] ..... F41G 3/02

[52] U.S. Cl. ..... 89/41 L; 351/7; 351/160 R

[58] Field of Search ..... 89/41 L; 244/3.16; 250/341; 351/7, 160 R, 160 H; 356/152

[56] References Cited

U.S. PATENT DOCUMENTS 3,712,716 1/1973 Cornsweet et al. ..... 351/7

OTHER PUBLICATIONS

Ditchburn et al., "The Stabilised Retinal Image", Optica Actica, vol. 2, No. 3, Oct. 1955, pp. 128–133.

*Primary Examiner*—Stephen C. Bentley
*Attorney, Agent, or Firm*—Erwin S. Teltscher

[57] ABSTRACT

A contact lens adapted to fit over the eye of an operator can be employed to focus light impinging on the lens from a light source and reflected therefrom, substantially onto a predetermined region by an eye movement of the operator.

9 Claims, 3 Drawing Figures

DEVICE AND METHOD OF ILLUMINATING A TARGET BY THE EYE-MOTION OF AN OPERATOR

BACKGROUND OF THE INVENTION

In U.S. Pat. No. 3,986,030 there is disclosed a device for impinging a light ray, preferably within a region of the spectrum not visible to the human eye, such as an infra-red ray, onto the cornea of the human eye, which is reflected therefrom and directed by eye movement onto a particular key of a keyboard, a photo-electric converter converting the light ray impinging on the selected key to strike the latter, if, and only if, an additional activating signal is concurrently received by the mechanism, the additional activitating signal being commanded, for example, by the suction of the operator on a specially fitted hose. The aforementioned device suffers from the disadvantage that a light ray reflected from the cornea is diffuse and not collimated or focused, so that, unless the keys of the keyboard are widely spaced apart, there is a risk of activating neighboring keys, in addition to a desired key. The need has therefore arisen to find a way of focusing the cornea-reflected light rays directly on the selected key of he keyboard, even if the keys of the keyboard are spaced closely to one another.

SUMMARY OF THE INVENTION

It is accordingly an object of the present invention to focus light rays impinging on the cornea or an element disposed on the cornea of a human eye and reflected therefrom to a predetermined region.

This object is attained by providing a contact lens adapted to fit over the eye of an operator, including means for focusing light rays impinging on the lens and reflected therefrom substantially onto a predetermined region by an eye movement of the operator.

The lens advantageously includes an inner transparent region adapted to substantially fit over the pupil of the eye, and an outer region surrounding the inner region. The outer region has an outer surface defining a plurality of recesses, and a corresponding portion of the surface of the outer region of the lens has a light-reflecting property, and is shaped so as to focus the lens-reflected light rays onto the predetermined region.

It is another object of the present invention to illuminate a target by the eye motion of an operator, which is accomplished by fitting at least one eye of the operator with a lens of the type capable of focusing a light source onto a predetermined region, arranging the light source in the vicinity of the operator, and moving the eye-fitted lens so as to focus the light rays impinging on the lens and reflected therefrom onto the predetermined region.

An external mechanism can then be trained onto the predetermined region by means of light reflected from the predetermined region. Targeting can be accomplished, for example, by directing a laser beam onto the predetermined region, the external mechanism being for example a pulsed laser, or shooting at the predetermined region from a gun or the like.

In an advantageous embodiment the light source is an invisible light source, and preferably an infra-red light source.

In a method of illuminating a target by the eye motion of an operator the steps include fitting at least one eye of the operator with a lens of the type capable of reflecting rays from a light source, and of focusing the reflected rays onto a predetermined region, arranging the light source in the vicinity of the operator, and moving the eye-fitted lens so as to focus the light rays reflected from the lens onto the predetermined region, so that a portion of the light rays reflected from the lens, are, in turn, reflected from the predetermined region.

It is advantageous to detect the light reflected from the predetermined region, and to train an external mechanism onto the predetermined region.

The training step may include directing a laser beam at the predetermined region from a laser light source, and triggering the laser at an appropriate moment of time, or shooting at the predetermined region from a gun, and again triggering the gun at a moment of time deemed suitable by the operator.

The light source may be an invisible light source, such as a source of infra-red light.

BRIEF DESCRIPTION OF THE DRAWING

The invention will be better understood with the aid of the accompanying drawing, in which.

DESCRIPTION OF THE PREFERRED EMBODIMENTS

Figure 2:
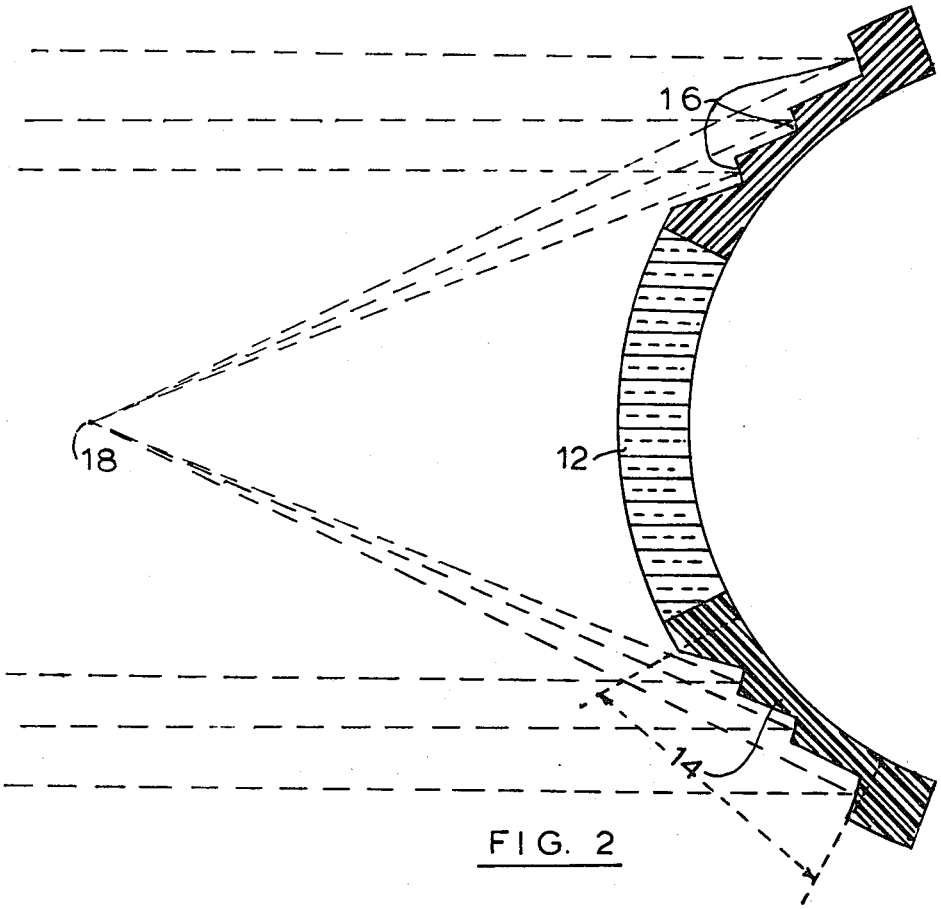
FIG. 2 shows a section of the lens, along line 2—2 of FIG. 1, with light rays impinging on the lens and being reflected therefrom, so as to focus on a predetermined region.
Figure 1:
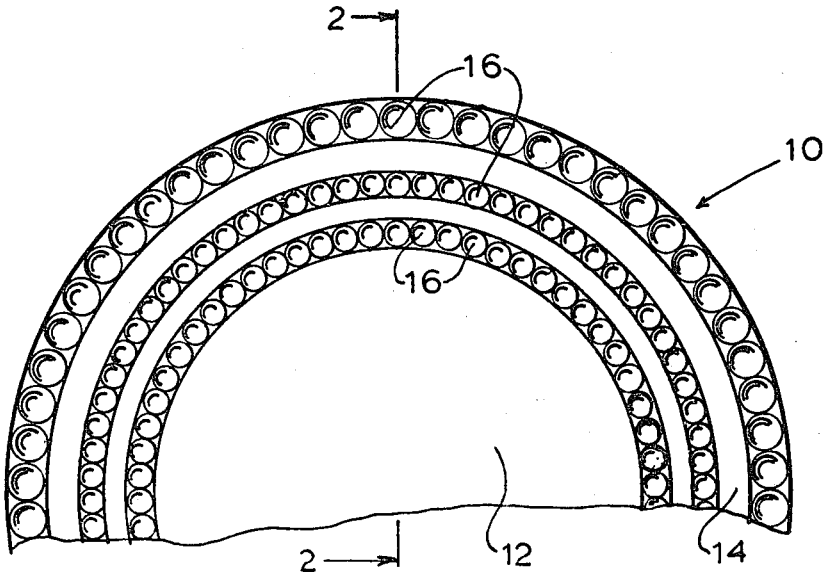
FIG. 1 shows an elevational view of the lens, according to the present invention.
Figure 3:
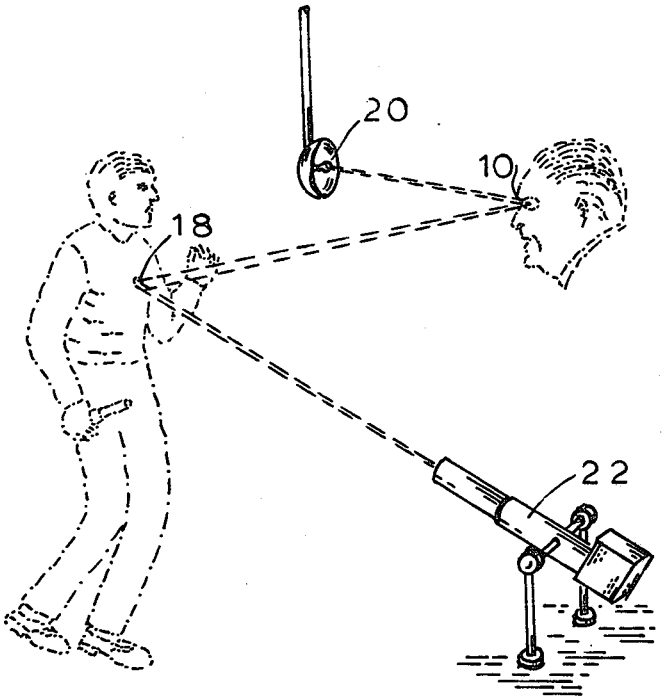
FIG. 3 shows the targeting of a predetermined region by an external mechanism, guided by the reflected light from the predetermined region.

Referring now to the drawing, a contact lens 10 will be seen to include an inner transparent region 12, and an outer region 14 surrounding the inner region 10, the outer region 14, having, for example, the shape of an annulus. The contact lens 10 is adapted to fit over the eye of a living human being, and may be either of the hard, or of the soft type. The surface defining the outer boundary of the lens 10 within the inner region 12 shown in FIG. 1 will therefore usually be convex.

The inner region 12 of the lens 10 has an area dimensioned to substantially fit over the pupil of the eye, and the outer region 14 of the lens 10 will be seen to have a plurality of recesses 16; a corresponding portion of the outer region of the outer surface of the lens 10 defining each recess 16 is light-reflecting, and has a shape so as to focus light rays reflected from the light-reflecting areas of the zone defining the boundary between the recesses and the outer region of the lens onto a predetermined region 18 spaced at a substantially predetermined distance from the lens. This shape may, for example, define a portion of a parabola, which in turn, may be approximated by a segment of a sphere.

It will be appreciated that if the lens 10 is fitted over the eye of an operator, a predetermined region 18 can be selected to have light focused thereon from the light-reflecting portions of the lens 10 by an appropriate eye movement of the operator.

In a method of illuminating a predetermined region or target 18 by the eye motion of an operator, at least one eye of the operator is fitted with a lens 10 of the type capable of focusing a light source 20 onto the predetermined region or target 18; the light source 20 is arranged within the vicinity of the operator, and the eye-fitted lens 10 is moved, so as to focus the light source onto the target or predetermined region 18.

An external mechanism 22 can then be trained onto the predetermined region 18 through light reflected from that predetermined region. The external mechanism 22 may be either a laser source of light, or a gun, or the like, from which, shots can be fired at the predetermined region 18. For example a laser could be used to blind a person, such as a hijacker, at least temporarily, while a gun could be used to shoot such a person. The scanning of an area to detect light reflected from the predetermined region or target 18, and subsequent training of the external mechanism 22 onto the target 18 and the tracking thereof is well known, and does not form part of this invention. It is described, for example, in chapter 5 entitled "Tracking Radar" of "Introduction to Radar Systems", by Merril I. Skolnik, McGraw-Hill Book Co. Inc. 1962. The scanning and tracking techniques of Radar can be transferred to light rays relatively easily; the distance to the target need not be measured.

Although the invention has been described with respect to a preferred version thereof, it is to be understood that it is not to be so limited since changes can be made therein which are within the full intended scope of the appended claims.

What is claimed is:

1. A contact lens adapted to fit over the eye of an operator, comprising means for focusing light rays impinging on the lens from a light source and reflected therefrom, substantially onto a predetermined region by an eye movement of said operator, said lens having an inner transparent region adapted to substantially fit over the pupil of the eye, and an outer region surrounding said inner region, said outer region having an outer surface defining a plurality of recesses, a corresponding portion of the surface of the outer region of said lens defining each of said recesses having a light-reflective property, and being shaped so as to focus the lens-reflected light onto said predetermined region.

2. A contact lens according to claim 1, wherein the portion of the surface of the outer region of the lens defining each recess is substantially parabolic.

3. A contact lens according to claim 1, wherein the portion of the surface of the outer region of the lens defining each recess is substantially spherical.

4. In a method of illuminating a target by the eye motion of an operator with the aid of a lens, said lens comprising means for focusing light rays impinging on the lens from a light source, and reflected from the lens, substantially onto a predetermined region by an eye movement of a wearer of the lens, the lens having an inner transparent region adapted to substantially fit over the pupil of the eye, and an outer region surrounding said inner region, said outer region having an outer surface defining a plurality of recesses, a corresponding portion of the surface of the outer region of said lens defining each of said recesses having a light-reflecting property, and being shaped so as to focus the lens-reflected light onto said predetermined region, the steps comprising:

fitting at least one eye of the operator with said lens, arranging the light source in the vicinity of the operator, and moving the eye-fitted lens so as to focus the light rays reflected from the lens onto said predetermined region, whereby a portion of the light rays reflected from the lens are, in turn, reflected from the predetermined region.

5. In a method according to claim 4, further comprising the step of detecting light reflected from said predetermined region, and training an external mechanism onto said predetermined region.

6. In a method according to claim 5, wherein the training step comprises directing a laser beam at said predetermined region, the external mechanism being a laser light source.

7. In a method according to claim 5, wherein the training step comprises shooting at said predetermined region, the external mechanism being a gun.

8. In a method according to claim 4, wherein said light source is an invisible light source.

9. In a method according to claim 8, wherein said invisible light source is an infra-red light source.

* * * * *